United States Patent [19]

Watson

[11] Patent Number: 4,723,452

[45] Date of Patent: Feb. 9, 1988

[54] BELT DRIVEN PUMPING UNIT

[75] Inventor: Jerry L. Watson, Odessa, Tex.

[73] Assignee: Grooves & Lands, Inc., Midland, Tex.

[21] Appl. No.: 941,582

[22] Filed: Dec. 16, 1986

Related U.S. Application Data

[60] Continuation of Ser. No. 696,539, Nov. 26, 1984, abandoned, which is a division of Ser. No. 550,452, Nov. 8, 1983, abandoned, which is a continuation-in-part of Ser. No. 237,533, Feb. 23, 1981, abandoned.

[51] Int. Cl.[4] ..... F04B 47/02

[52] U.S. Cl. ..... 74/41

[58] Field of Search ..... 74/41

[56] References Cited

U.S. PATENT DOCUMENTS

| | | | |
|---|---|---|---|
| 162,406 | 4/1875 | Nickerson | 74/41 |
| 510,366 | 12/1893 | Raky | 74/41 |
| 633,619 | 9/1899 | Smith | 74/41 |
| 713,269 | 11/1902 | Wright | 74/41 |
| 1,169,772 | 1/1916 | Chapman | 92/140 |
| 1,257,897 | 2/1918 | Lloyd | 74/41 |
| 1,286,617 | 12/1918 | Hebbard | 74/61 |
| 1,501,226 | 7/1924 | Malbaff | 74/41 |
| 1,890,807 | 12/1932 | Faber | 74/41 |
| 2,153,094 | 4/1939 | Maier | 74/41 |
| 2,169,493 | 8/1939 | Humphrey | 74/41 |
| 2,274,601 | 2/1942 | Hartgering et al. | 74/41 |
| 2,526,561 | 10/1950 | Keltner | 74/41 |
| 3,144,778 | 8/1964 | Lott | 74/41 |
| 3,310,988 | 3/1967 | Gault | 74/41 |
| 3,406,581 | 10/1968 | Eyler et al. | 74/41 |
| 4,051,736 | 10/1977 | Jones | 74/41 |
| 4,139,334 | 2/1979 | Dayne | 417/545 |
| 4,238,966 | 12/1980 | Carlson et al. | 74/41 |
| 4,505,162 | 3/1985 | Hoh et al. | 74/41 |

*Primary Examiner*—Lawrence Staab

*Attorney, Agent, or Firm*—Eric P. Mirabel

[57] ABSTRACT

A pumping unit has very large series connected crank and flywheel sheaves. The crank sheave is connected to oscillate a walking beam which reciprocates a horsehead attached to a bridle. The bridle is connected to a polished rod associated with a downhole pump.

5 Claims, 6 Drawing Figures

BELT DRIVEN PUMPING UNIT

CROSS REFERENCES TO RELATED APPLICATIONS

This application is a continuation of application Ser. No. 696,539, filed Nov. 26, 1984, now abandoned, which is a division of application Ser. No. 550,452, filed Nov. 8, 1983, which is in turn a continuation-in-part of Ser. No. 237,533, filed Feb. 23, 1981, now abandoned. Application Ser. No. 550,452 has been abandoned in favor of a file wrapper continuation thereof Ser. No. 20,220, filed Mar. 9, 1987.

BACKGROUND OF THE INVENTION

Most prior art methods of driving a pumping unit usually include a gear box or a chain and sprocket arrangement for part of the drive train. Heretofore, it has been impractical to employ endless belts made of fabric and rubber-like material because the structural integrity of these prior art endless belts unduly limit the torque associated with the very low rpm requirements of a pumping unit.

Recently, Goodyear Rubber Company has marketed a line of belts called "Torque Team Plus" which overcomes the problem of stretching at low rpm torque capabilities. These improved belts exhibit good structural characteristics in transferring torque at low rpm requirements of a pumpjack unit.

The present invention provides an efficient belt driven pumping unit which combines the function of a crank arm, counterweights, support, and sheave all into one common part, thereby reducing production cost and space requirements.

SUMMARY OF THE INVENTION

A belt driven pumping unit comprising a belt driven large flywheel sheave connected to a large crank sheave by another endless belt. A walking beam is journaled to a Samson post and connected to the crank sheave by a pitman arm, so that the crank sheave oscillates the walking beam which in turn rocks a horsehead. A bridle connected to the horsehead and to a polished rod reciprocates a downhole pump.

The flywheel sheave comprises a hub supported from a flange by a plurality of spokes. The spokes are formed by adjacent spaced apart cutouts. The crank sheave also includes a hub spaced from a flange by means of a plurality of spokes. The cutouts from each of the sheaves are accumulated and utilized as a counterweight within the crank sheave.

The crank of the crank sheave is located on the sheave and enables power to be transmitted from the outer surface of the crank sheave flange, through the crank and pitman arm, and into the walking beam and horsehead, thereby providing a high torque for the pumping unit while eliminating the necessity of large power transmission through a hub, key, or shaft mechanism. This new combination of elements provides unexpected advantages in the pumping unit described herein.

The flywheel sheave, which is the first large sheave in the power train, acts as an energy dampening system which provides a smooth flow of power throughout the unit. Because of this flywheel effect, a smaller horsepower motor may be installed in order to achieve the same motion comparable to that of a conventional pumping unit.

The cutouts which form the spokes in the flywheel sheave and crank sheave are utilized as the counterweights on the crank sheave.

The dimensional relationship between the crankshaft, tail-bearing center, Samson shaft center, and pitman arm link results in a complex motion that generates a more rapid downstroke and a slower upstroke, wherein the crank sheave turns approximately 165 degress, for example, to achieve the downstroke and approximately 195 degrees, for example, for the upstroke. This desirable characteristic provides unforeseen and unexpected advantages by reducing the peak acceleration loads on the sucker rod, which in turn decreases sucker rod fatigue while increasing sucker rod life.

Accordingly, a primary object of the present invention is the provision of a belt driven pumping unit which utilizes large belt driven sheaves in the power train.

Another object of the present invention is the provision of an efficient and economical pumpjack unit having a belt driven crank sheave which provides the function of a crank arm, counterweight, support, and sheave, all combined into one common member, thereby reducing the production cost and space requirements.

Still another object of the present invention is the provision of a power train for a pumping unit which includes two large belt driven sheaves, having spokes formed thereon, and wherein the drops from spoking the sheave are used as a counterweight on the crank sheave, thereby reducing material waste.

A further object of this invention is the provision of an improved belt driven power train for a pumping unit which utilizes a large flywheel sheave to drive a large crank sheave, which in turn reciprocates a horsehead of a walking beam.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
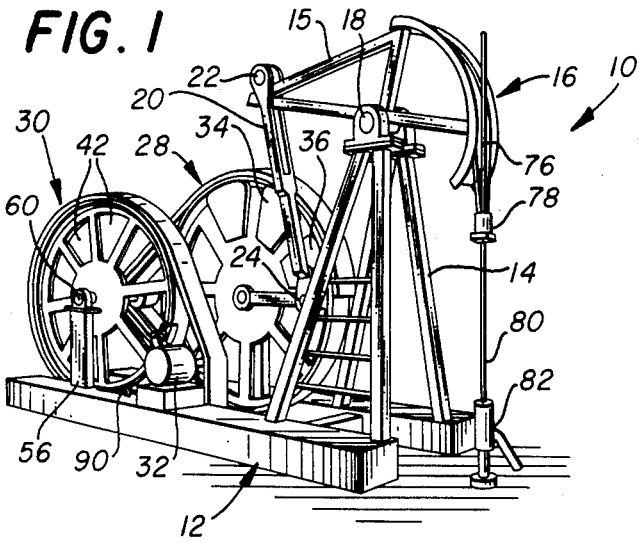
FIG. 1 is a perspective view of a belt driven pumpjack unit made in accordance with the present invention.
Figure 4:
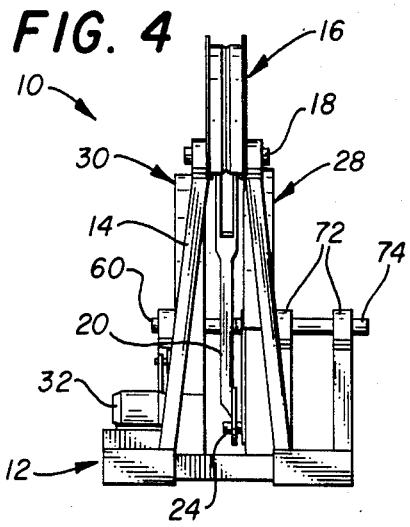
FIG. 4 is an end view of the pumping unit disclosed in FIG. 2.
Figure 2:
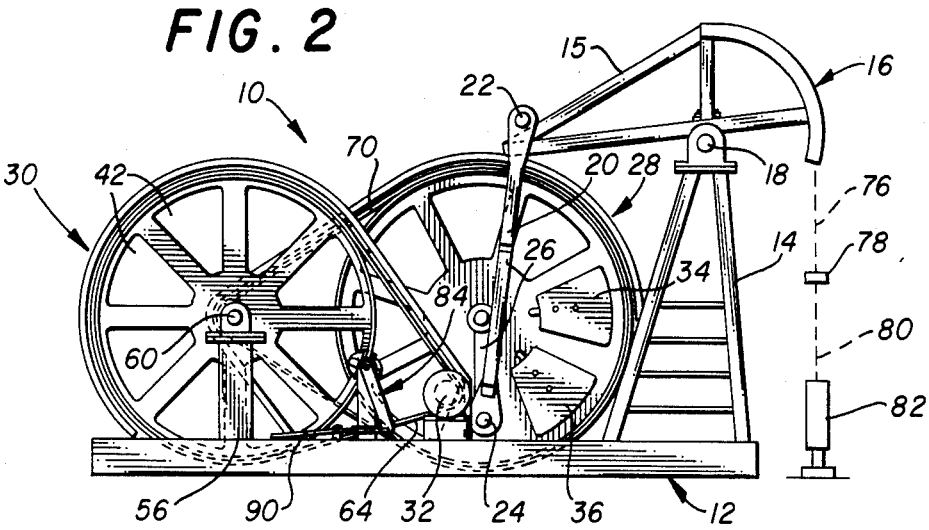
FIG. 2 is a side elevational view of a pumping unit such as disclosed in FIG. 1.
Figure 3:
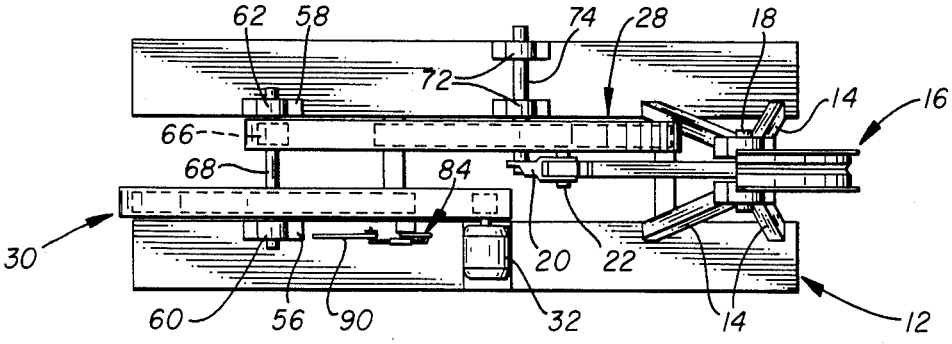
FIG. 3 is a top plan view of the pumping unit disclosed in FIG. 1.

In FIGS. 1–4 of the drawings, there is disclosed a pumping unit 10 supported from a base or frame 12. The unit includes a Samson post 14 which supports a walking beam 15 having a horsehead 16 formed at one end thereof. A Samson shaft center 18 supports a medial portion of the walking beam in journaled relationship therewith, while one end of a pitman arm 20 is journaled to the tailbearing center 22 of the walking beam.

A wrist pin center 24 is journaled to the other end of the pitman arm. The wrist pin is connected to crank 26 which in turn is connected to a very large diameter crank sheave 28.

A very large diameter flywheel sheave 30 is operatively positioned in spaced relationship respective to a motor 32 and to the before mentioned crank sheave.

Figure 5:
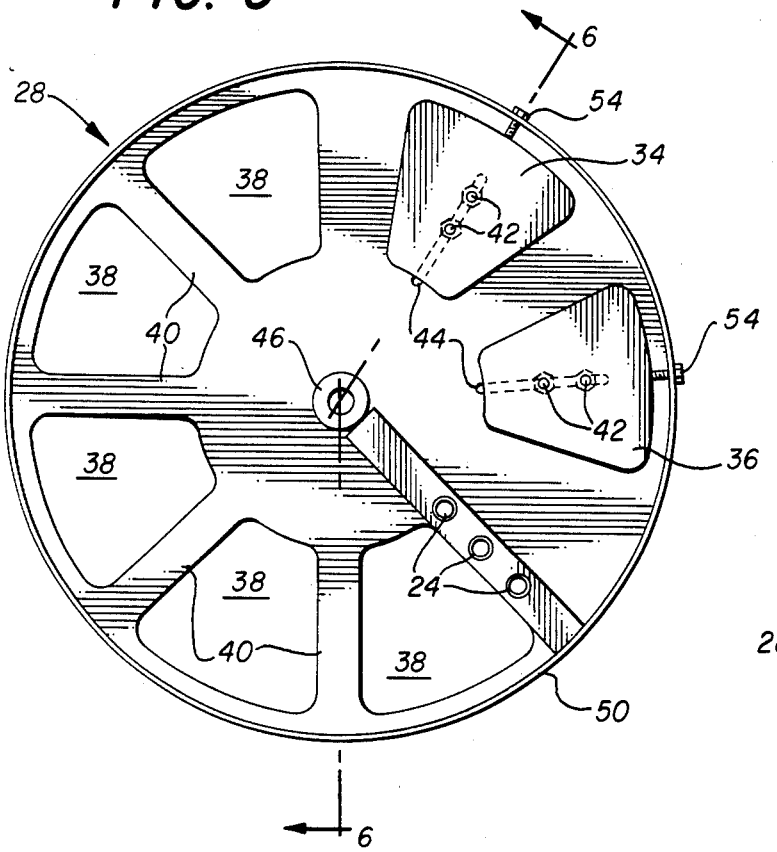
FIG. 5 is an enlarged, side elevational view of part of the apparatus disclosed in the foregoing figures.
Figure 6:
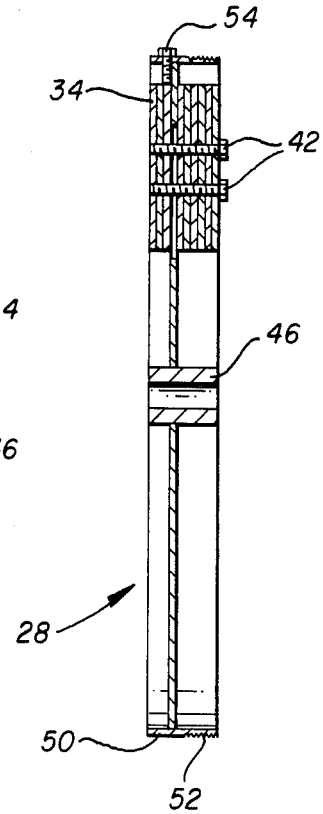
FIG. 6 is a cross-sectional view taken along line 6—6 of FIG. 5.

As best seen illustrated in FIG. 5, the crank sheave includes removable counterweights 34 and 36 positioned at an angle of approximately 50° respective to one another and at an angle of approximately 75° respective to the wrist pin center 24. The relative location of the counterweights can be changed respective to one another and the wrist pin to achieve other pumping characteristics, if desired.

As seen in FIG. 5, cutouts 38 form the illustrated spokes 40 of the crank sheave, and provides the before mentioned counterweights 34 and 36. Bolts 42 are diametrically received within radial slots 44 for adjustably anchoring the counterweights 34 and 36 to the crank sheave. The position of the slots and counterweights may be varied to optimize the maximum counterweight effect achieved by the employment of minimum counterweights 34 and 36.

Crank sheave 28 includes a hub 46. Crank 26, in the form of a radial arm, extends from the hub radially, and extends outwardly to the sheave flange 50. The outer peripheral surface of the flange may be grooved at 52, if desired, complementary respective to an endless belt 70. A jacking bolt 54 can be used to position the counterweights along the radial slot 44, if desired.

Looking again now to FIG. 3, in conjunction with other figures of the drawings, it will be noted that spaced upright standards 56 and 58 are provided with journal bearings 62 for receiving opposed ends 60 of flywheel sheave shaft 68 in low friction relationship therewith. Belt 64, connects the flywheel sheave to the motor 32. Small sheave 66 is affixed to the flywheel sheave shaft 68 for causing the endless belt 70 to drive crank sheave 28.

The main frame carries spaced journal bearings 72 which receive crank sheave shaft 74 in low friction relationship therewith so that the crank sheave is journaled in supported relationship relative to the main frame 12.

As seen in FIG. 1, a bridle is attached to the horsehead and to a clamp 78, made in accordance with the present invention. The clamp receives a polish rod 80 which extends through a packing gland and into a wellhead 82, in a manner known to those skilled in the art.

Brake assembly 84 is connected to frictionally engage the opposed faces of the flywheel sheave flange, so that the pumping apparatus can be secured against rotation.

The geometry of the horsehead, rocking beam, Samson shaft center, and tailbearing center are arranged relative to one another and to the pitman arm to achieve a motion which reciprocates the rod string causing it to move more rapidly on the downstroke as compared to the upstroke. The crank sheave in the illustrated example of FIGS. 1–4 turns counter-clockwise, when viewed with the Samson shaft center 18 to the right of crank sheave shaft 74, as in FIGS. 1 and 2, turning about 165° on the downstroke and about 195° on the upstroke. This characteristic can be changed to achieve variation in the relative stroke time intervals as follows:

The wrist pin center 24, crank shaft center 74, and tailbearing center 22 lie along a common line when viewed at the end of the upstroke and at the end of the downstroke. These two common lines converge at a location 74, the crank shaft axis is as identified in FIG. 4. The tailbearing center 22 moves towards the Samson shaft journal an amount depending upon the relative position or location of the centers 18, 22, 24, and 74. This relationship determines the magnitude of the angle B, which in turn determines the relative amount of rotation of the crank sheave which is required to achieve the upstroke and downstroke of the polished rod. The angle can therefore be changed to reflect an increase or decrease in the 165°/195° relationship; however, it has been found that 165°+10° and 195°+10° is the optimum relationship when all of the variables are considered, and 165/195 represents an efficient compromise.

I claim:

1. Pumping unit comprising a Samson post, a walking beam having a head end and a tail end, a Samson bearing pivotally mounting the walking beam on the Samson post at a location between said head and tail ends of the walking beam, horsehead means at the head end of the walking beam adapted for connection to well pump actuation means, drive means connected to the tail end of the walking beam for translating the rotary motion of a suitable driver to oscillating motion of the walking beam about the Samson bearing, said oscillating motion including a downstroke of said horsehead means and an upstroke of said horsehead means, said drive means comprising a crank means mounted for rotation about an axis, a pitman, wrist means pivotally connecting one end of the pitman to the crank means, and tail bearing means pivotally connecting the other end of the pitman to the walking beam at said tail end of the walking beam, said drive means when actuated by such driver causing said walking beam to oscillate said tail bearing means predominately above the horizontal plane of the Samson bearing, said tail bearing means being closer to the vertical plane through the crank axis than the vertical plane through the Samson bearing at the beginning of the downstroke and closer to the vertical plane through the Samson bearing than the vertical plane through the crank axis at the end of the downstroke.

2. The pumping unit of claim 1, the circle in which moves said wrist means as the crank means rotates being transected by the vertical plane through the tail bearing means when said tail bearing means is in its lowest position, the vertical plane through said tail bearing means when said tail bearing means is in its highest position passing outside said circle.

3. The pumping unit of claim 2, said wrist means, the axis of said crank, tailbearing means, and Samson bearing being arranged whereby the plane through said Samson bearing and said tailbearing means is nearer to horizontal than vertical when said wrist means is in its lowermost position wherein the wrist means radius from said axis is parallel to the vertical plane through the Samson bearing, and whereby when said wrist means is in its highest position wherein the wrist means radius from said axis is also parallel to said vertical plane through the Samson bearing, the plane through said Samson post bearing and tailbearing means is nearer to vertical than horizontal.

4. The pumping unit of claim 3 wherein said wrist means is connected to be rotated by said crank means counterclockwise viewed with the Samson bearing at the right, the wrist means and pitman moving mainly down on the left side of the crank means during the upstroke of the horsehead means and up and on the right side of the crank means during the downstroke of the horsehead means, said drive means causing said horsehead means to move down during a shorter arc of rotation of said wrist means about said axis than the arc through which said wrist means turns during which said drive means causes said horsehead means to move up.

5. The pumping unit of claim 4 wherein:

the crank means turns within 10 degrees of 165 degrees to provide the downstroke and within 10 degrees of 195 degrees to provide the upstroke, said crank having counterweights affixed thereto at a location beginning in the quadrant immediately adjacent said wrist pin and ranging counterclockwise from said wrist pin measured in the direction of wrist pin rotation about the axis of said shaft means on which said crank sheave is mounted.

* * * * *